US006623367B1

(12) United States Patent
Labelson et al.

(10) Patent No.: US 6,623,367 B1
(45) Date of Patent: Sep. 23, 2003

(54) AMUSEMENT RAMP AND METHOD FOR CONSTRUCTING SAME

(75) Inventors: Ross Labelson, 900 Bromton Dr., Westbury, NY (US) 11590; Timothy J. Klima, Washington, DC (US)

(73) Assignee: Ross Labelson, Westbury, NY (US)

( * ) Notice: Subject to any disclaimer, the term of this patent is extended or adjusted under 35 U.S.C. 154(b) by 0 days.

(21) Appl. No.: 09/356,508

(22) Filed: Jul. 19, 1999

(51) Int. Cl.[7] ..... A63C 19/10
(52) U.S. Cl. ..... 472/89; 472/90
(58) Field of Search ..... 472/89, 90, 136; 14/69.5, 71.1, 78; 256/59, 64; 52/182, 183; D21/817

(56) References Cited

U.S. PATENT DOCUMENTS

| | | | | |
|---|---|---|---|---|
| 2,499,959 | A | | 3/1950 | Kruse et al. |
| 2,724,495 | A | | 11/1955 | Wasyluka |
| 3,271,222 | A | | 9/1966 | Moorman |
| 3,406,617 | A | | 10/1968 | Randazzo |
| 3,573,401 | A | * | 4/1971 | Lininger ..... 179/147 |
| 3,581,630 | A | | 6/1971 | Del Piano |
| 3,771,891 | A | | 11/1973 | Nirenski et al. |
| 3,790,019 | A | | 2/1974 | Murray et al. |
| 3,976,526 | A | | 8/1976 | Hovey et al. |
| 4,030,729 | A | | 6/1977 | Nathaniel |
| 4,102,975 | A | | 7/1978 | Doerer |
| 4,129,916 | A | | 12/1978 | Schlesinger et al. |
| D256,488 | S | | 8/1980 | Firestone |
| D257,874 | S | | 1/1981 | Sheehan et al. |
| D258,460 | S | | 3/1981 | Firestone |
| 4,285,514 | A | | 8/1981 | Romero |
| 4,367,870 | A | | 1/1983 | Birch |
| 5,100,358 | A | | 3/1992 | Volgger |
| 5,203,948 | A | | 4/1993 | Suska |
| 5,454,196 | A | | 10/1995 | Gaines et al. |
| 5,524,310 | A | | 6/1996 | Farnen |
| 5,599,235 | A | | 2/1997 | Lynberg |
| 5,718,412 | A | | 2/1998 | Levanas |

* cited by examiner

*Primary Examiner*—Kien T. Nguyen
(74) *Attorney, Agent, or Firm*—Pillsbury Winthrop LLP

(57) ABSTRACT

The present invention provides a fingerboard ramp having a base having at least one riding surface and a metal rail or a metal coping attached to the base to provide an additional riding surface for a fingerboarder.

23 Claims, 7 Drawing Sheets

AMUSEMENT RAMP AND METHOD FOR CONSTRUCTING SAME

FIELD OF THE INVENTION

The present invention applies to amusement ramps and methods for constructing same, and, more particularly, to fingerboard and skateboard ramps.

DESCRIPTION OF THE PRIOR ART

Ramps for fingerboards and skateboards are known in the art. Fingerboarding is the imitation of skateboarding using the fingers, a miniature skateboard (fingerboard) and optionally, a miniature ramp for performing stunts imitating the stunts performed by a skateboarder. These ramps are used for performing stunts by the riders and are also for use with roller skates, in-line skates and BMX bikes. For example, Schlesinger, U.S. Pat. No. 4,129,916 discloses an Adjustable Skateboard Ramp, Romero, U.S. Pat. No. 4,285,514 discloses a Ramp Device for Practicing Wheeled Sports, Farnen, U.S. Pat. No. 5,524,310 discloses a Modular Half-pipe Skateboard Ramp and Method of Constructing and Sheehan, U.S. Pat. No. Des. 257,874 and Firestone, U.S. Pat. No. Des. 258,460 show designs for skateboard ramps. These references disclose a number of different designs of ramps and methods for constructing the ramps. Some of these references disclose the use of one-piece unitary riding surfaces, while other ramps known in the prior art disclose the use of multi-piece riding surfaces.

Further, none of the toy fingerboard ramps heretofore known offered by others utilize metal railings and/or copings and thus, lack realism as compared to actual full-sized skateboard ramps.

SUMMARY OF THE INVENTION

The present invention provides a ramp having an underlying supporting structure and a ramp section having a unitary riding surface. The supporting structure includes a pair of side frames of similar shape. The two side frames are connected together by a plurality of crossbraces to form a supporting structure with an upper supporting surface generally having a desired shape of the finished ramp. The ramp section can be constructed of a unitary piece of material or of a composite construction. It is generally flat and constructed to have enough flexibility to conform to the upper supporting surface of the supporting structure to provide the desired ramp shape while having enough stiffness to properly support the rider. The supporting frames are each provided with at least two locating tabs that project above the upper supporting surface of the supporting structure to engage corresponding notches in the ramp section. In this way, the ramp section can be initially installed on the supporting structure and will be held in place by the engagement of the tabs with the notches until the ramp section can be more securely fastened to the supporting structure. This self-locking mechanism allows one person to temporarily position and install the ramp section to the supporting structure so that the ramp section can then be secured to the supporting structure for use by the riders.

In an alternative embodiment of the present invention, the fingerboard ramp is constructed of plastic or other formable material and is formed by molding or vacuum forming. Provision is made for attaching metal railings and/or copings to the ramp. Since actual full-sized skateboard ramps use metal railings and copings, the metal railings and copings of the fingerboard ramp give a more realistic appearance to the fingerboard ramp. Further, the sound and feel made by a skateboarder on a skateboard ramp when the skateboard contacts and slides along the metal components is distinctive. Thus, the metal railings and copings of the fingerboard ramp also provide a more realistic sound, feel and experience to the fingerboarder when the fingerboard contacts and slides along these metal components. These advantages are not provided in fingerboard ramps having nonmetallic railings and copings.

It is an object of the present invention to provide an amusement ramp having a supporting structure and a ramp section, whereby the ramp section can easily be installed to the supporting structure by one person.

It is a further object of the present invention to provide an amusement ramp having a supporting structure and a ramp section, whereby the ramp section can easily be temporarily installed to the supporting structure by one person to subsequently allow for more secure installation.

It is a further object of the present invention to provide a method for installing a surface section to a supporting structure whereby tabs on one of the surface section or the supporting structure engage notches or slots in the other of the surface section or supporting structure to position and hold the surface section with respect to the supporting structure.

It is a further object of the present invention to provide a fingerboard ramp utilizing metal railings and/or copings to provide a more realistic sound, feel and experience to the fingerboarder.

The foregoing and other objects, features, characteristics and advantages of the present invention, as well as the methods of operation and functions of the related elements of structure, and the combination of parts and economies of manufacture, will be apparent from the following detailed description and the appended claims, taken in connection with the accompanying drawings, all of which form a part of the specification, wherein like reference numerals designate corresponding parts in the various figures.

DETAILED DESCRIPTION OF THE INVENTION

Figure 1:
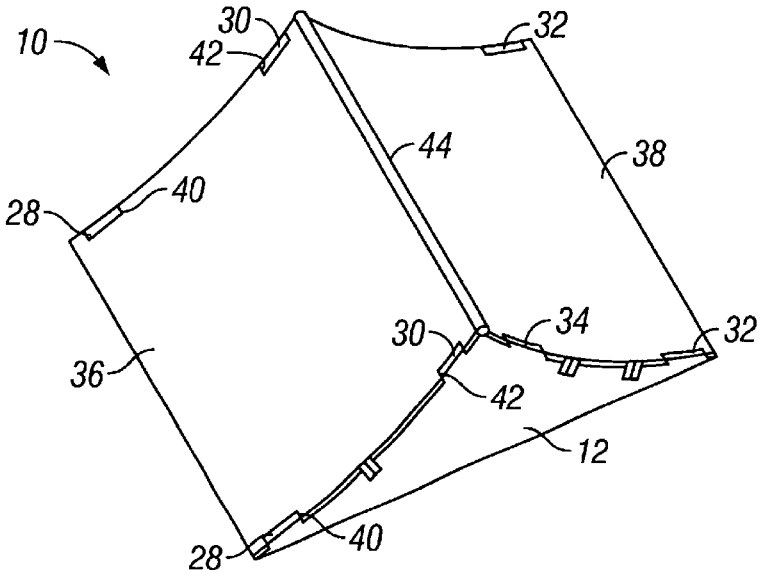
FIG. 1 is a perspective view of a ramp of the present invention.
Figure 2:
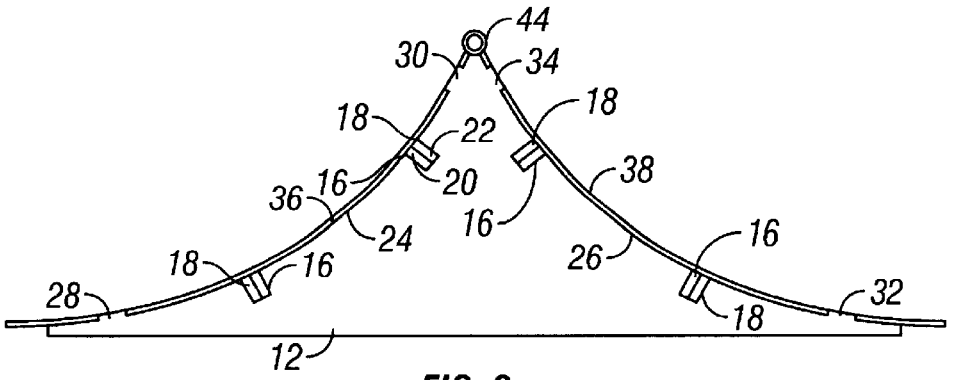
FIG. 2 is a side elevational view of the ramp of FIG. 1.
Figure 3:
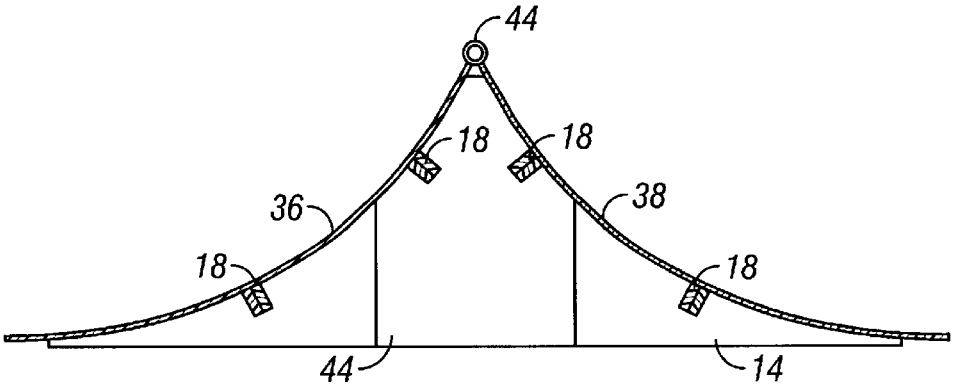
FIG. 3 is a sectional view of the ramp of FIG. 1.
Figure 4:
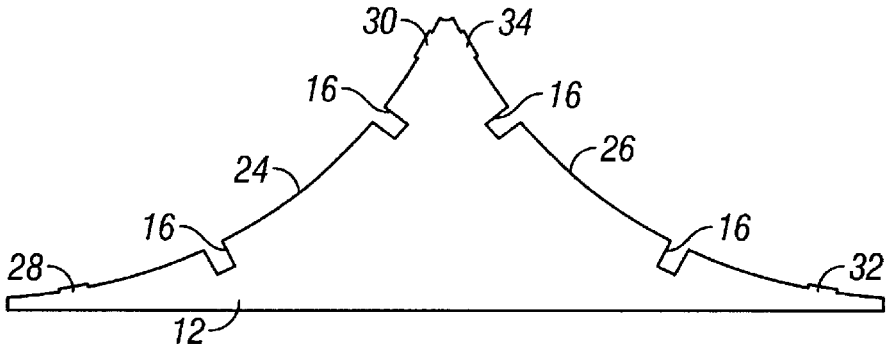
FIG. 4 is a side elevational view of a side frame of the ramp of FIG. 1.

FIG. 1 shows a perspective view of a ramp 10 of the present invention. The ramp includes a pair of side frames 12 and 14 (side frame 14 can be seen in FIG. 3). Each side frame has a plurality of notches 16 for supporting a like plurality of crossbraces 18. Each crossbrace 18 is positioned in a corresponding pair of notches 16 in the side frames 12 and 14 to attach the two side frames together and form a supporting structure. The crossbraces can be attached to the side frames by any known method, including glue, screws, nails, brackets, etc. Each crossbrace 18 can be constructed from a unitary piece of material or, as shown, can be constructed from two separate pieces of material 20 and 22 and attached together, again by any known method. Depending on the length of the supporting structure, it may be desirable to add one or more center frames to the structure to strengthen it. These frames can be shaped like the side frames (with or without the locating tabs discussed below) or can be truncated. The center frame or frames can be shaped as shown in FIG. 3, wherein center frame 44 has truncated sides as compared to the side frames, and does not include any locating tabs.

Figure 5:
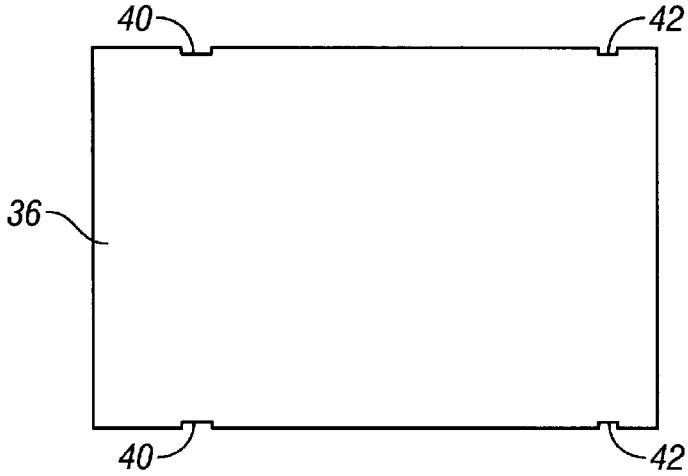
FIG. 5 is a top elevational view of a ramp section of the ramp of FIG. 1.

Each side frame also has two supporting surfaces 24 and 26. Supporting surface has two extending locating tabs 28 and 30 and supporting surface 26 has two extending locating tabs 32 and 34. Supporting surface 24 supports a ramp section 36 and supporting surface 26 supports a ramp section 38. As can be seen in FIG. 5, ramp section 36 is of a generally rectangular shape and has two locking notches or slots 40 and two locking notches or slots 42. The locking notches 40 are adapted to engage the locating tabs 28 on side frames 12 and 14 and the two locking notches 42 are adapted to engage the locating tabs 30 on side frames 12 and 14. The locating tabs 28 (and correspondingly, the locking notches 40) can be the same width as the locating tabs 30 (and correspondingly, the locking notches 42) with both tabs and notches symmetrically located so that the ramp section has no specific required orientation with respect to the supporting structure. Alternatively, the notches and tabs can be of different widths and/or spacing so as to require a specific orientation of the ramp section to the supporting structure upon installation. Since in this embodiment the two ramp sections 36 and 38 are similar to each other, the description above with respect to ramp section 36 would also correspondingly apply to ramp surface 38.

While the supporting surfaces 24 and 26 are curved, the ramp sections 36 and 38 are generally flat in their relaxed state. In such situations, it is often difficult to position the ramp sections and get them to conform to the curved supporting surfaces without additional hands, holding weights and/or clamping mechanisms. However, the provision of the locking notches and locating tabs minimizes or eliminates such need.

The distance between notches 40 and 42 is set to be the same distance between the tabs 28 and 30 along the curve of the supporting surface 24 (the arc length). This distance is longer than the straight-line distance between the tabs 28 and 30 (the chord length). By positioning ramp section 36 so that the notches 40 engage the locating tabs 28, the ramp section can then be carefully pressed in toward the supporting surface 24 while being held in place by the locating tabs 28. As the ramp section 36 is pressed into to place to conform to the supporting surface 24, starting from the notches 40 and working toward the notches 42, the notches 42 will come into alignment with the tabs 30 so that the this end of the ramp section can be pressed against the supporting surface to engage notches 42 with tabs 30. The force of the ramp section 36 trying to return to its relaxed, flat state causes a spring lock between the notches 40 and 42 and tabs 28 and 30, respectively, thereby temporarily holding the ramp section in place until more secure or permanent fasteners can be utilized or take effect (such as glue). Depending on the specific design of the ramp and materials, the spring lock may be sufficient to hold the ramp section to the supporting structure without additional fasteners. The tab/notch engagement is also believed to improve the overall strength of the secure attachment between the ramp sections and the support structure by helping to maintain a secure positioning between the two.

This effect can usually be accomplished by the use of two tab/notch pairs at the outer ends of the curve as shown with the above embodiment, but if desired, additional tab/notch pairs can also be utilized. Further, even if the supporting surface is not curved, but flat, the tab/notch pairs can be used to accurately position and hold the ramp section to the supporting surface, although no spring locking will be in effect under such circumstances. Alternatively, the ramp section can be provided with tabs for engaging notches in the supporting structure or can utilize a combination of tabs and notches for engaging a corresponding combination of notches or tabs on the supporting structure. Although the tabs and notches are shown to be rectangular, they can be of any desired shape, including round, triangular, etc. The tabs and notches need not be provided at the edge of the ramp section/supporting structure but can be provided elsewhere on the ramp section/supporting structure. The notches are shown herein to be open on one side but they can also be closed on all sides and need not completely pierce the ramp section/supporting structure but may be in the form of blind holes. Alternatively, the ramp section and supporting structure can be provided with pre-existing bores that will align when the ramp section is pressed down to conform to the support surface such that pins, bolts, or screws, etc. can be inserted through the aligned bores to retain the ramp section to the supporting structure.

The ramp 10 also includes an edge coping at the intersection of the ramp sections 36 and 38 to provide a uniform, durable contact surface. The edge coping 44 in the preferred fingerboard embodiment is constructed of round metal tubing and glued to the ramp, but other materials, shapes and methods of attachment can also be utilized.

The ramp of the present invention can be constructed of various types of materials. For, instance, the ramps can be constructed of wood, plastic, cardboard or metal and different materials can be used for different components. In one multi-piece embodiment of the present invention used as a fingerboard ramp, the ramp is constructed from die-cut pieces of relatively thin, soft wood sheets. The sheets can be of the same thickness or have different thicknesses for different components. It may also be desirable to construct the ramp section from a harder wood or other material to provide increased durability. Also the ramp section can be of a uniform material or can be of a composite construction of multiple layers, pieces or materials. While a bottom surface of the ramp section can be segmented, it is preferred, though not required, to maintain the top riding surface of the ramp section as a single unitary piece to provide an enhance riding surface. This provides an improved riding surface as compared to multi-piece riding surfaces of prior art devices.

In this fingerboard embodiment, the components are presently held together with glue. Further, the glue for attaching the ramp section to the supporting surface is preferably applied to the contacting surfaces prior to assembly but can also be applied after assembly and locking of the ramp section to the supporting surface. In a larger embodiment, additional fastening mechanisms will likely be desired, including screws, bolts, nails, clamps, soldering, welding, etc. Alternatively, as discussed above, the tab and notch assembly of the components may be sufficient to hold the ramp together without further fasteners such as adhesives. In the fingerboard embodiment, a kit is provided with all of the necessary cut pieces for assembly by the user. The present invention makes it easier for the user to assemble the pieces into a finished ramp, especially when the user may be a teenager or younger child who has not developed the desired dexterity or may have limited additional tools to assist with the assembly. With smaller ramps such as fingerboard ramps, the assembly can be accomplished by a single person. Of course, larger ramps for skateboards, in-line skates, bikes, snowboards, etc., may require additional individuals for assembly. Further, the fingerboard ramp of the present invention can also be used for miniature in-line skates, miniature bicycles, miniature snowboards, etc.

Figure 6:
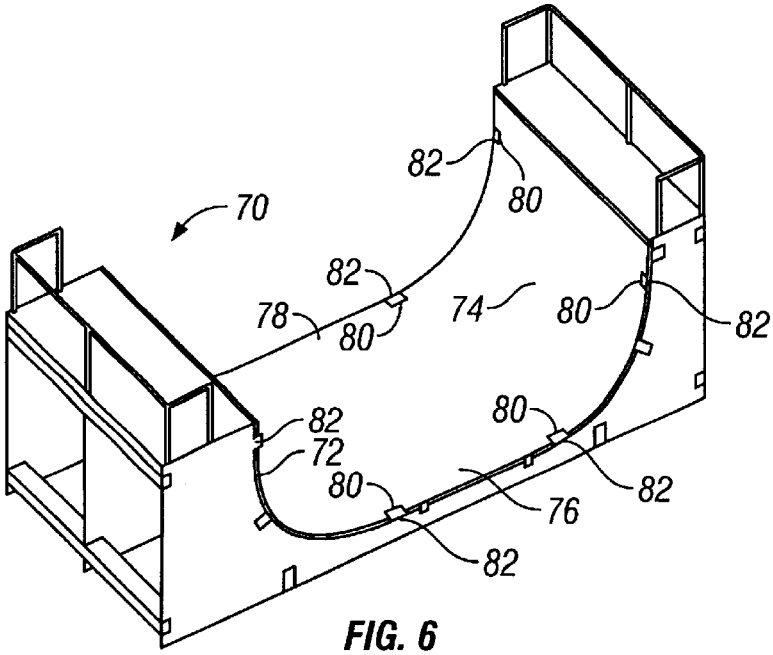
FIG. 6 is a perspective view of an alternative embodiment of a ramp of the present invention.

An alternative embodiment of the present invention is shown in perspective in FIG. 6. This ramp 70 includes two curved sections 72 and 74 facing each other and joined together by a flat intermediate section 76. Other than the shape of ramp 70, its construction is similar to the construction of ramp 10. A ramp section 78 is provided which includes a plurality of notches 80 which engage a like plurality of tabs for holding the ramp section 78 in place upon installation. In this embodiment, because of the relative length of the ramp section, it has been found to be desirable to align and engage the four middle notches 80 bordering the intermediate section 76 with the corresponding tabs 82 first and then holding this portion in place with a weight (such as a book) prior to engaging the outermost notches and tabs. This prevents the middle notches from disengaging from the middle tabs as the remaining notches are engaged with the remaining tabs. In another alternative embodiment, a halfpipe-shaped ramp can be constructed similarly to the ramp 70 by not providing the flat intermediate section 76 between the two curved sections 72 and 74. Alternative ramp shapes can also be utilized, including ramps where the side frames are not parallel to each other but can be at an angle to each other to form with the ramp section, for instance a truncated partial cone-shaped ramp. The present invention can also be applied to other types of structures where a surface sheet is being attached to a supporting structure.

Figure 7:
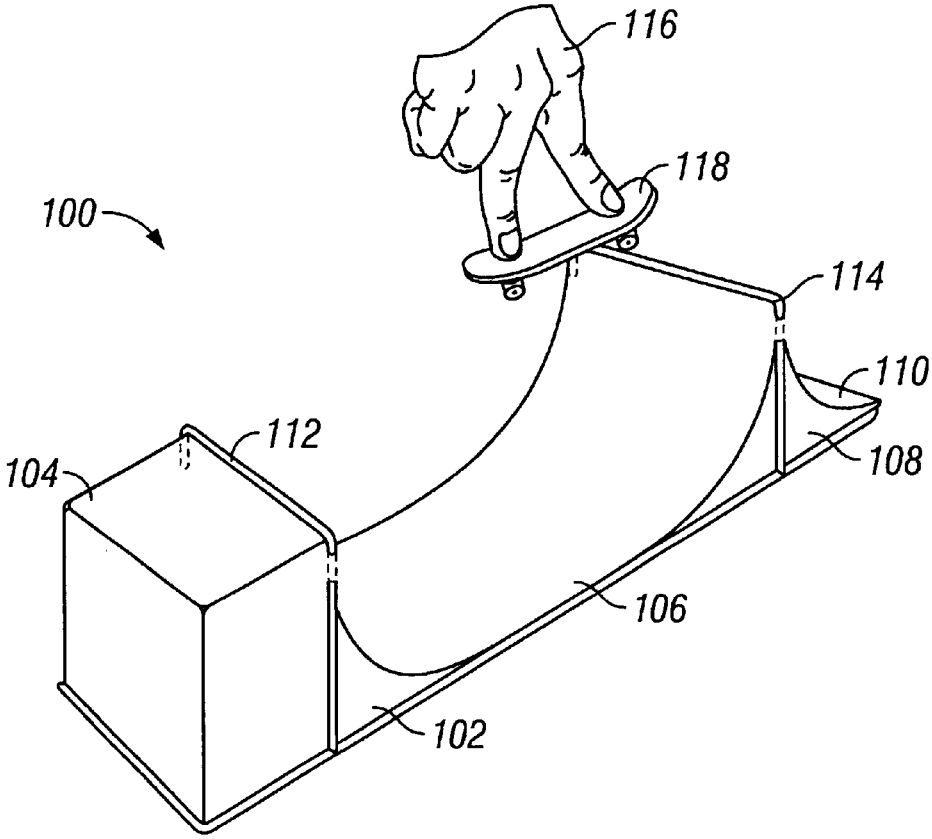
FIG. 7 is a perspective view of a further alternative embodiment of a ramp of the present invention.

In an alternative embodiment of the fingerboard ramp, as seen in FIG. 7, a ramp 100 includes a base 102 constructed of plastic as a unitary component. The base 102 can be molded, blow-molded, injection-molded, roto-molded, thermoformed, vacuum formed or constructed by other known methods. The configuration of the ramp 100 includes a platform 104, a "half-pipe" section 106 a "spine" 108 and a "quarter-pipe" section 110. Ramp 100 includes two metal copings 112 and 114 attached to the base 102. A fingerboarder 116 is shown engaging a fingerboard 118. In the presently preferred embodiment of FIG. 7, the base is approximately 6.25" high to platform 104, 28" long and 8.5" wide.

Figure 8:
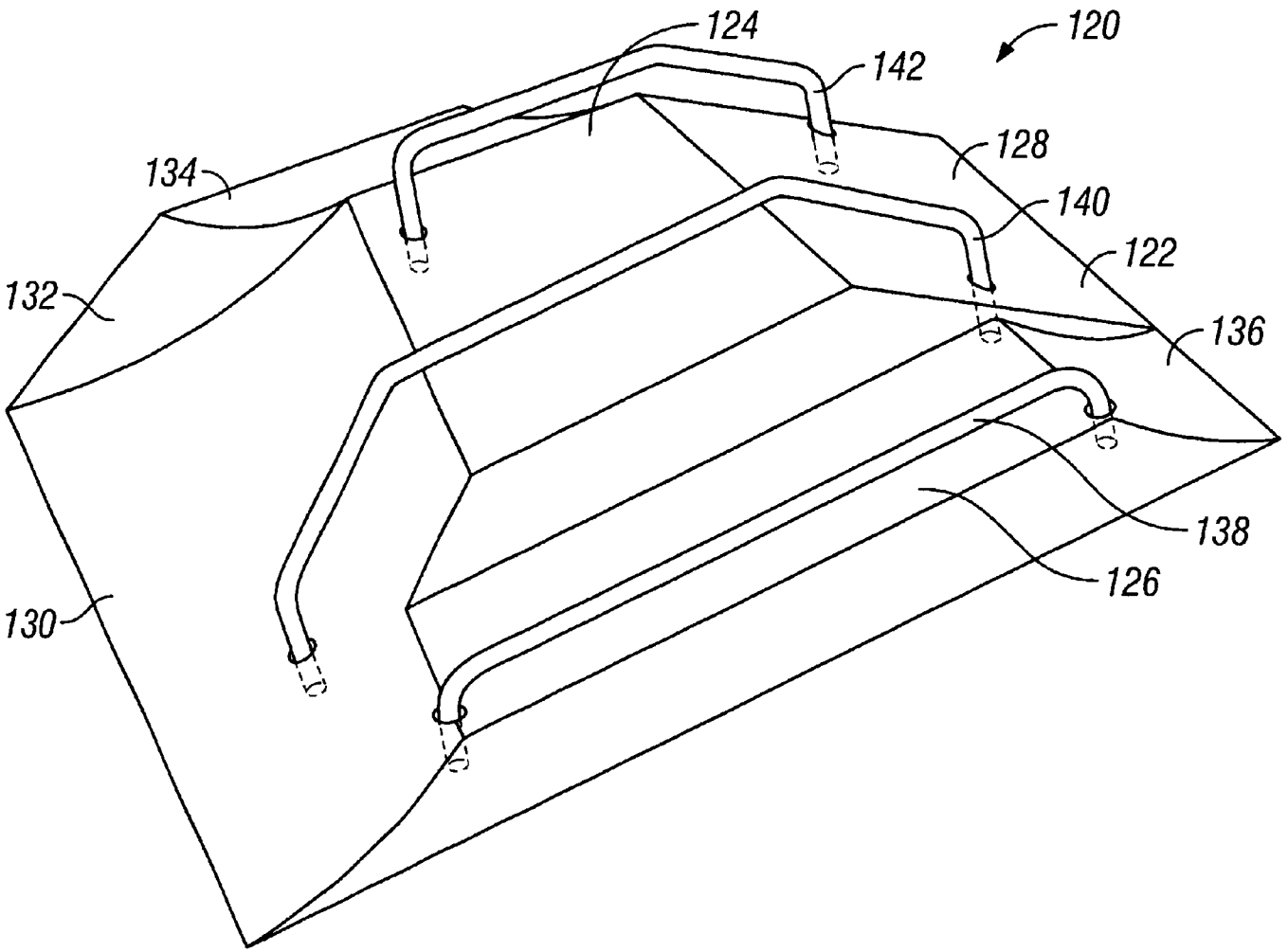
FIG. 8 is a perspective view of a further alternative embodiment of a ramp of the present invention.

In a further alternative embodiment of the fingerboard ramp seen in FIG. 8, a ramp 120 includes a base 122 constructed of plastic as a unitary component. The ramp 120 includes a number of differently configured riding surfaces, such as platforms 124 and 126, inclined ramp 128 and curved ramps 130, 132, 134 and 136. Rails 138, 140 and 142 are attached to the base 122 and are differently configured to coordinate with the different riding surfaces to provide a series of unique riding positions to the fingerboarder. In the presently preferred embodiment of FIG. 8, the base is approximately 3" high to platform 124, 16" long and 13.25" wide.

Figure 9:
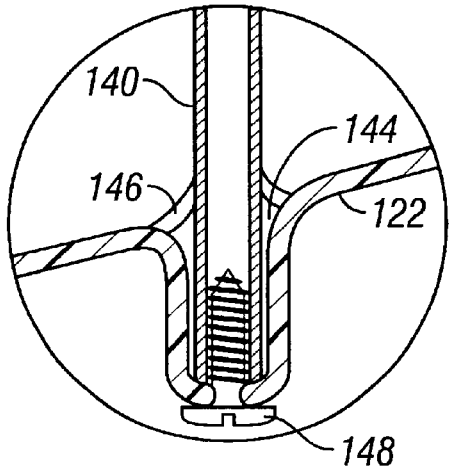
FIG. 9 is an enlarged view of one method of attaching a metal railing to the ramp of the present invention.

FIG. 9 shows one method of attaching a rail to the base of a ramp. A cavity 144 is provided in the base 122 for accepting an end of rail 140. In this embodiment, the cavity 144 is molded into base 122, but can alternatively be pierced or machined into the base. An adhesive 146 can optionally be used to provide additional strength to the rail/cavity joint, as can a screw 148 engaging the rail 140 and base 122. This method can be used for any of the ramp embodiments disclosed herein. While the rail 140 is shown to be hollow, it can also be solid, as can the rest of the rails and copings disclosed herein. The metal rails can be aluminum, steel or other metal and can be interchanged as desired to provide different feel and sound to the fingerboarder.

Figure 10:
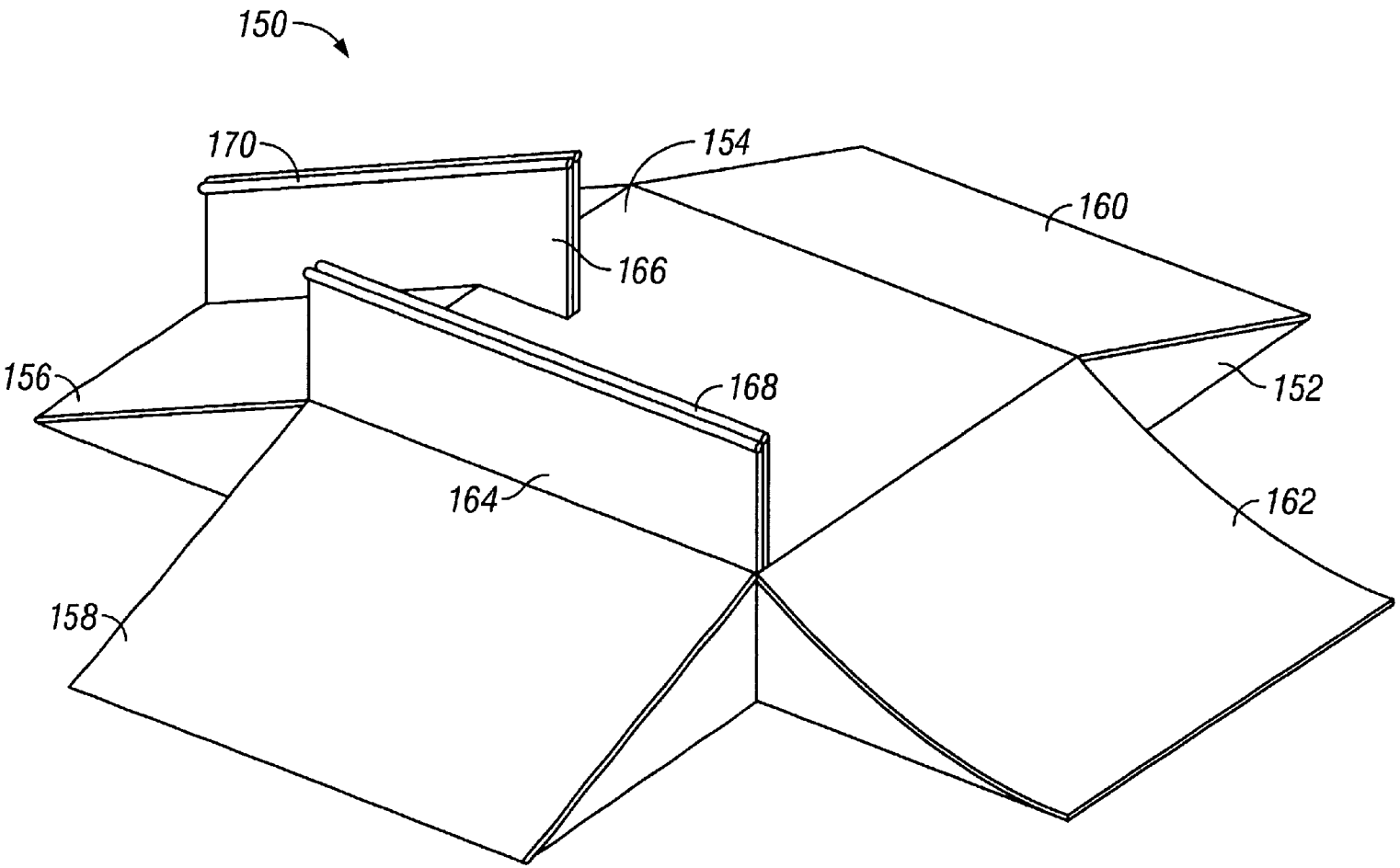
FIG. 10 is a perspective view of a further alternative embodiment of a ramp of the present invention.

FIG. 10 shows a further alternative embodiment of a fingerboard ramp. Ramp 150 includes a base 152 constructed either of plastic as a unitary component or wood of a unitary or multi-piece construction. The ramp 150 includes a number of different riding surfaces, such as platform 154, inclined ramps 156, 158 and 160, which can be of similar or different slopes, and a curved ramp 162. The ramp also includes a wall 164 on platform 154 and a wall 166 on both platform 154 and inclined ramp 156. Wall 164 includes a horizontal upper surface on which is mounted a horizontal metal coping 168. Wall 166 includes an inclined upper surface on which is mounted an inclined metal coping 170. The walls can be molded as a unitary part of base 152 or can be separate components attached to the base 152 with adhesive, screws, or other known fasteners. The metal copings 168 and 170 can be of one-piece or multi-piece construction and are attached to the respective walls by adhesive, screws or other known methods.

The riding surfaces of the ramps shown in FIGS. 7–10 can be provided with a smooth surface texture or, more preferably, a patterned surface texture which better approximates the surface texture of a skateboard ramp and thus, offers a more realistic sound, feel and experience to the fingerboarder. The ramps can be painted or coated with other known coatings, such as polymeric coatings, to better approximate full-sized skateboard ramps. The ramps can also be provided with strengthening ribs and support structure as needed to provide a stable structure to the fingerboarder. In the preferred embodiment the ramps have generally hollow bases open at the bottom.

Figure 11:
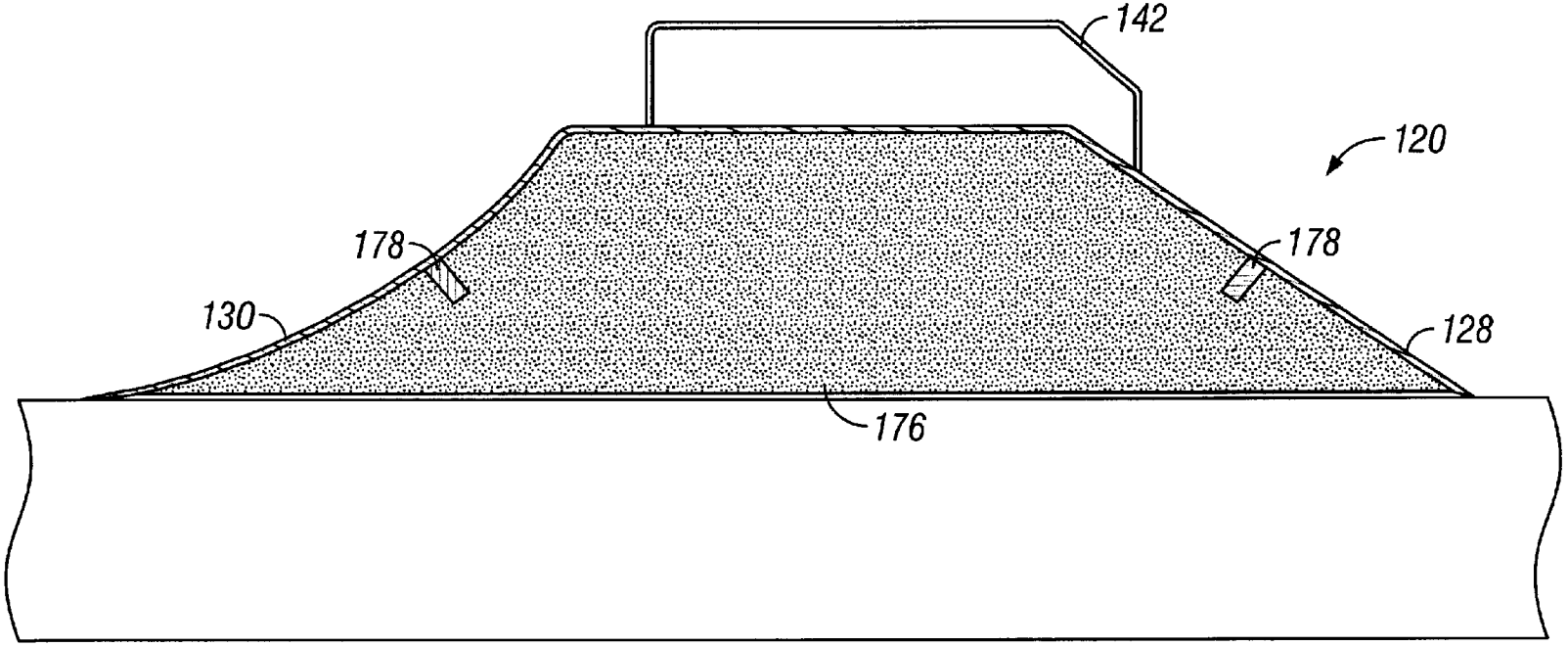
FIG. 11 is a sectional view of one embodiment of the ramp shown in FIG. 8.

Alternatively, enclosed hollow bases can also be used which are either completely enclosed or which include a sealable opening for accessing the hollow interior. In either the open hollow or enclosed hollow bases, the bases can be filled partially or fully with an additional substance. As shown in FIG. 11, a sectional view of one embodiment of the base shown in FIG. 8, such a substance can include a rigid foam 176, for strengthening the base, with ribs 178 provided in ramp 120 to help retain the foam 176. The foam 176 can also be glued into the base. The foam can also be used in an enclosed base for rigidity.

Figure 12:
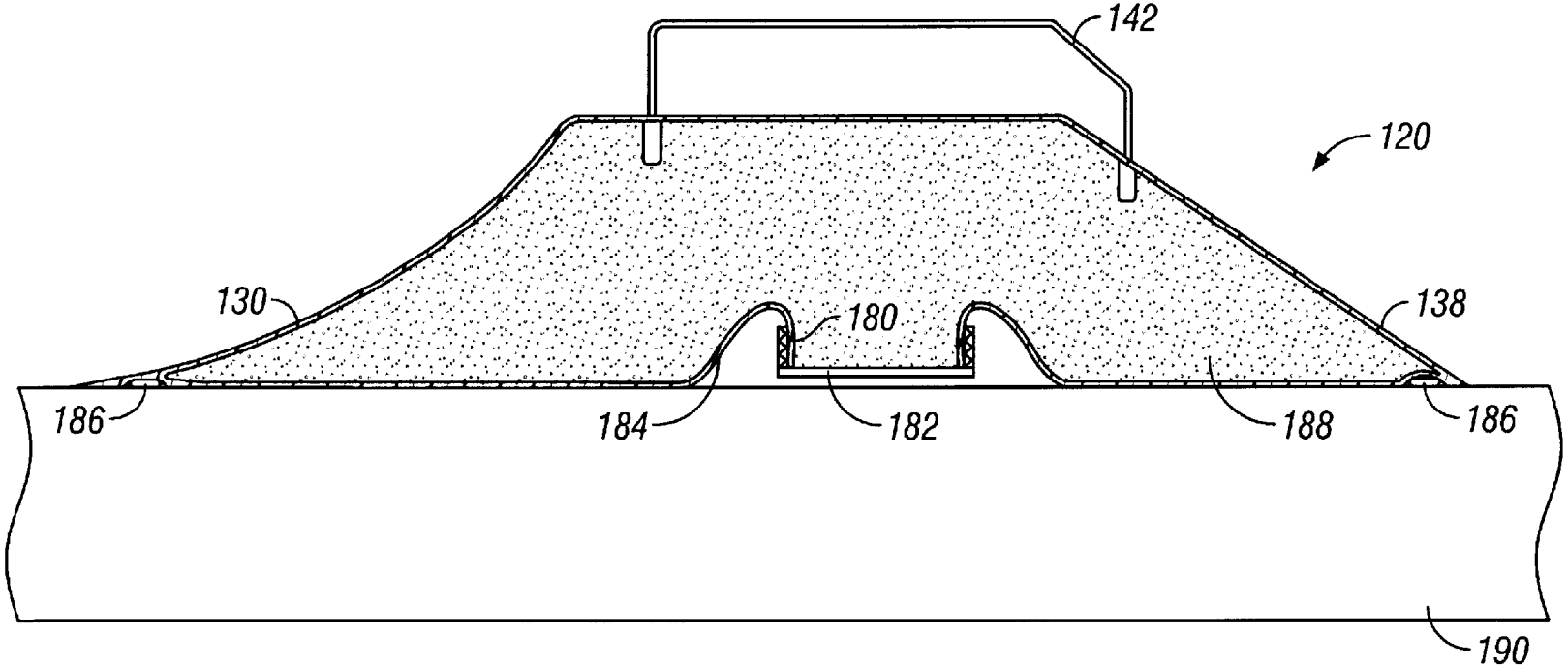
FIG. 12 is a sectional view of an alternative embodiment of the ramp shown in FIG. 8.

Alternatively, in an enclosed hollow base, sand, water or another dense substance can be added to the base to provide additional mass and stability to the base. Adding sand, water or other dense substance to the enclosed base also deadens the sound of the base, giving a sound better approximating the sound of a heavily constructed skateboard ramp. See FIG. 12 which shows a sectional view of an alternative embodiment of the ramp shown in FIG. 8. By providing a sealable opening 180 in the enclosed hollow base, such as a screw top with a cap 182 located in a recess 184 on the underside of the base, the sand 188 (or water or other dense substance) can be added by the user after purchase of the ramp to save on shipping and packaging expenses for the ramp. Other types of openings and caps can also be provided for access to the hollow interior. The strengthening, stabilizing and mass adding structures just described can also be applied to larger ramps and and full-sized skateboard ramps. Solid or semi-solid bases can also be used.

FIG. 11 also shows the use of rubber or polymeric pads attached to the underside of the base by known methods to provide an antiskid surface to the base. The pads can be located in depressions in the base bottom and have their thickness adjusted as desired to provide a desired engagement between the ramp and the surface it is placed on. That is, the height of the pads is adjusted to provide a desired antiskid effect while minimizing the gap between the ramp surfaces such as 128 and 130 and the supporting surface 190.

Although the bases of the ramps shown in FIGS. 7–12 are disclosed to be constructed of plastic, they can alternatively be constructed of other materials such as fiberglass or other fiber reinforced plastic, cast concrete, cast stone, machined wood or even formed, stamped, cast and/or machined metal. In addition, although these bases are preferably constructed as one-piece components, they can also be assembled from multiple pieces, utilizing for instance, the techniques disclosed above with respect to FIGS. 1–6.

While this invention has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the invention following, in general, the principles of the invention and including such departures from the present disclosure as come within known or customary practice in the art to which the invention pertains, and as may be applied to the essential features hereinbefore set forth and followed in the spirit and scope of the appended claims.

What is claimed is:

1. A fingerboard amusement ramp, comprising:

a base having at least one riding surface;

at least one of a metal rail or metal coping attached to the base to provide an additional riding surface; and a rigid material including foam configured to at least partially fill the base to increase the rigidity of the base.

2. A fingerboard amusement ramp as in claim 1, wherein the rigid foam is attached to the base with an adhesive.

3. A fingerboard amusement ramp, comprising:

a base having at least one riding surface; and at least one of a metal rail or metal coping attached to the base to provide an additional riding surface, wherein the base is resealably enclosed and is at least partially filled with a rigid material including rigid foam to increase the rigidity of the base.

4. An amusement ramp as in claim 3, further comprising a rigid material configured to be removably added to the base to increase the rigidity of the base.

5. A fingerboard amusement ramp, comprising:

a base having at least one riding surface; and at least one of a metal rail or metal coping attached to the base to provide an additional riding surface, wherein the base is resealably enclosed and has a unitary construction.

6. A fingerboard amusement ramp as in claim 5, wherein the base is filled with a rigid material to increase the rigidity of the base.

7. A fingerboard amusement ramp as in claim 6, wherein the rigid material is a rigid foam.

8. A fingerboard amusement ramp as in claim 5, wherein the base is filled with a dense material to increase the mass and stability of the base.

9. A fingerboard amusement ramp as in claim 5, wherein the base includes an opening for resealably engaging a cap for resealing the base.

10. A fingerboard amusement ramp as in claim 9, wherein the opening is threaded for resealably engaging a threaded cap.

11. A fingerboard amusement ramp, comprising:

a base having at least one riding surface and having a unitary construction;

at least one of a metal rail or metal coping attached to the base to provide an additional riding surface; and at least one antiskid pad attached to a bottom surface of the base for engaging a ramp supporting surface.

12. An amusement ramp, comprising:

a base having at least one riding surface; and an additional material at least partially filling the base, wherein the base is resealably enclosed such that the additional material can be added to an interior of the base to increase at least one of a rigidity, mass and stability of the base, and wherein the base includes at least one socket for receiving at least one end of at least one of a metal rail and a metal coping.

13. An amusement ramp as in claim 12, wherein the at least one end of the at least one of a metal rail and a metal coping is attached to the socket of the base with an adhesive.

14. An amusement ramp as in claim 13, wherein the at least one end of the at least one of a metal rail and a metal coping is also attached to the socket of the base with at least one of a screw and a bolt.

15. An amusement ramp as in claim 12, wherein the additional material can be removably added to the interior of the base.

16. An amusement ramp, comprising:

a base having at least one riding surface; and an additional material at least partially filling the base, wherein the base is resealably enclosed such that the additional material can be added to an interior of the base to increase at least one of a rigidity, mass and stability of the base, and wherein the additional material includes a rigid material to increase the rigidity of the base.

17. An amusement ramp as in claim 12, wherein the additional material can be removably added to the interior of the base.

18. An amusement ramp, comprising:

a base having at least one riding surface; and an additional material at least partially filling the base to increase at least one of a rigidity, mass and stability of the base, wherein the base is resealably enclosed such that the additional material can be added to an interior of the base to increase at least one of a rigidity, mass and stability of the base, and wherein the additional material includes a dense material to increase the mass and stability of the base.

19. An amusement ramp as in claim 18, wherein the additional material can be removably added to the interior of the base.

20. An amusement ramp, comprising:

a base having at least one riding surface, wherein the base is resealably enclosed such that an additional material can be added to an interior of the base to increase at least one of a rigidity, mass and stability of the base, and wherein the base includes a threaded opening for resealably engaging a threading cap for resealing the base.

21. An amusement ramp, comprising:

a base having at least one riding surface, wherein a bottom of the base is open, and a rigid material including rigid foam at least partially filling the open base to increase a rigidity of the base.

22. An amusement ramp as in claim 21, wherein the rigid foam is attached to the base with an adhesive.

23. A fingerboard amusement ramp as in claim 22, wherein the base includes at least one rib for retaining the rigid material.

* * * * *

UNITED STATES PATENT AND TRADEMARK OFFICE

CERTIFICATE OF CORRECTION

PATENT NO. : 6,623,367 B1 
DATED : September 23, 2003
INVENTOR(S) : Labelson et al.

It is certified that error appears in the above-identified patent and that said Letters Patent is hereby corrected as shown below:

Title page,
Please insert the following after Item [22]:

-- Related U.S. Application Data

[63] Continuation-in-part of application No. 09/245,352, filed on February 5, 1999, now Pat. No. 6,042,480. --

Signed and Sealed this

Twenty-seventh Day of January, 2004

JON W. DUDAS
*Acting Director of the United States Patent and Trademark Office*